United States Patent [19]

McCallum

[11] Patent Number: 4,461,579

[45] Date of Patent: Jul. 24, 1984

[54] MOTIONLESS MIXER COMBINATION

[75] Inventor: Henry McCallum, Mississauga, Canada

[73] Assignee: Statiflo, Inc., Markham, Canada

[21] Appl. No.: 492,384

[22] Filed: May 6, 1983

Related U.S. Application Data

[63] Continuation-in-part of Ser. No. 288,846, Jul. 31, 1981, abandoned.

[51] Int. Cl.[3] ..... B01F 5/00

[52] U.S. Cl. ..... 366/337

[58] Field of Search ..... 366/336, 337, 338, 339, 366/340; 138/38, 42

[56] References Cited

U.S. PATENT DOCUMENTS

| | | | |
|---|---|---|---|
| Re. 28,072 | 7/1974 | Sluijters | 366/337 |
| 3,051,453 | 8/1962 | Sluijters | 366/337 |
| 3,239,197 | 3/1966 | Tollar | 366/337 |
| 3,328,003 | 6/1967 | Chisholm | 366/337 |
| 3,643,927 | 2/1972 | Crouch | 366/337 |
| 3,652,061 | 3/1972 | Chisholm | 366/337 |
| 3,862,022 | 1/1975 | Hermann | 204/272 |
| 3,893,654 | 7/1975 | Miura et al. | 366/337 |
| 3,923,288 | 12/1975 | King | 366/336 |
| 4,019,719 | 4/1977 | Schuster et al. | 366/338 |
| 4,034,965 | 7/1977 | King | 366/338 |
| 4,068,830 | 1/1978 | Gray | 366/174 |
| 4,164,375 | 8/1979 | Allen | 366/337 |

FOREIGN PATENT DOCUMENTS

| | | | |
|---|---|---|---|
| 2208226 | 9/1973 | Fed. Rep. of Germany | 366/338 |
| 1386955 | 3/1975 | United Kingdom | 366/338 |
| 604573 | 4/1978 | U.S.S.R. | 366/338 |

*Primary Examiner*—Philip R. Coe
*Assistant Examiner*—Michael Knick
*Attorney, Agent, or Firm*—Robert B. Russell

[57] ABSTRACT

A motionless mixer combination is provided comprising modules made up of basic mixer components formed from flat stock and having an isosceles triangular base plate and a pair of vanes connected at equal and opposite angles to the legs of the triangle of the base plate. Modules are made up of combinations of the basic mixer components to provide equal and oppositely directed helical flow paths with the fluid flowing substantially longitudinally of the line of all included angles and transverse to the line of all reflex angles. The modules are also provided with means for subjecting the fluid to a strong mixing action by intersecting fluid streams along a transverse line in the vicinity of where the fluid flows into a downstream module from an adjacent upstream module.

12 Claims, 27 Drawing Figures

FIG. 2
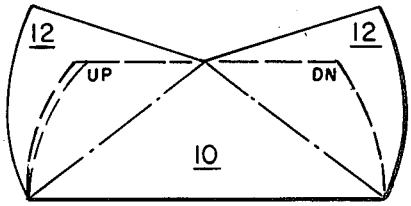
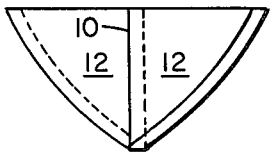
FIG. 3
FIG. 4
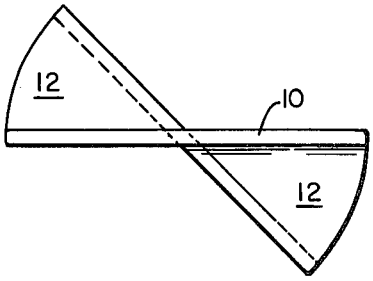
FIG. 5
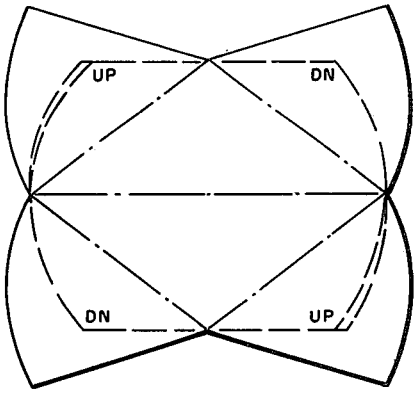
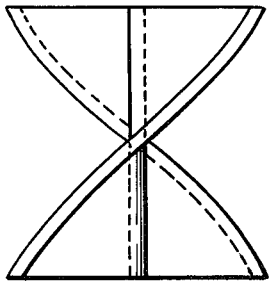
FIG. 6
FIG. 7
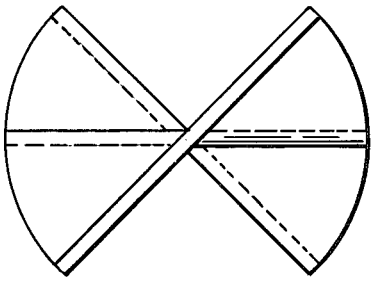
FIG. 8
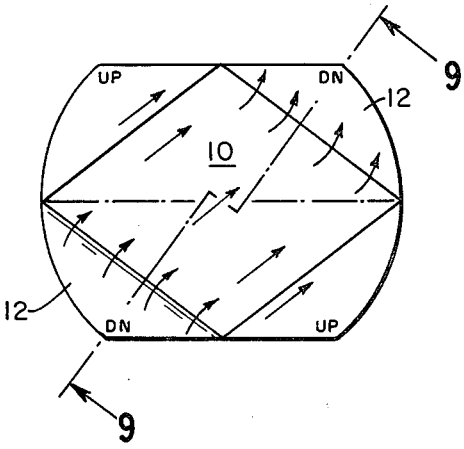
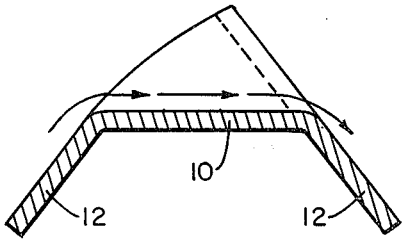
FIG. 9

FIG. 10
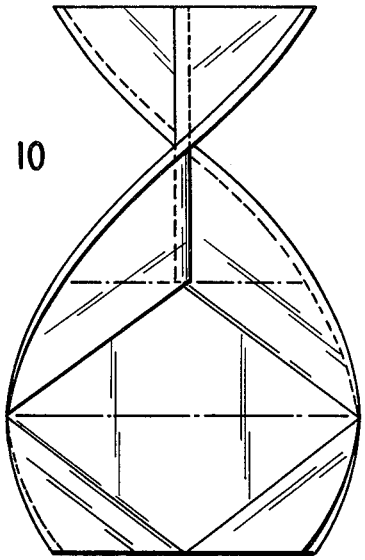
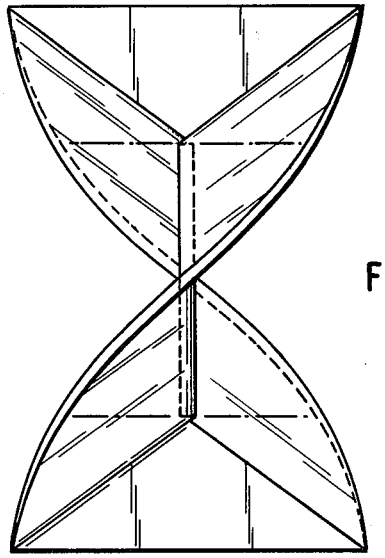
FIG. 11
FIG. 12
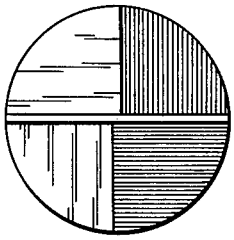
FIG. 13
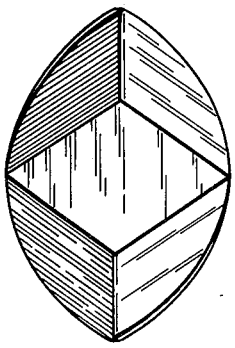
FIG. 14
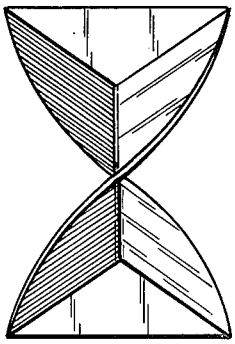
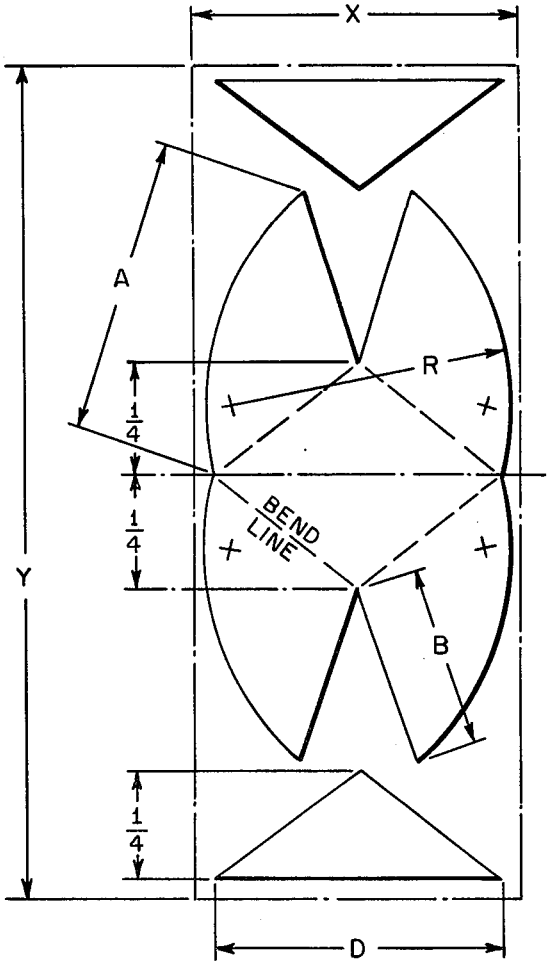
FIG. 15

FRONT

ROTATED 45° RIGHT

MOTIONLESS MIXER COMBINATION

FIELD OF THE INVENTION

This invention is a continuation-in-part of prior application Ser. No. 288,846, filed on July 31, 1981, and now abandoned, entitled Static Mixer (Inventor Henry McCallum).

The invention relates to mixers and more particularly to fixed or static devices in conduits arranged to cause a mixing action responsive to the flow through the conduit, of the substances to be mixed. Such devices are commonly called "motionless mixers".

BACKGROUND OF THE INVENTION

Motionless mixers have a wide variety of industrial uses. They are used to advantage in any context where two or more substances, one of which is usually a fluid, require mixing. Typical applications are for mixing chemicals in industrial processes, mixing multi-part curing systems for adhesives, foams and molding compounds, mixing fuels and gases for combustion, mixing air into water for sewage treatment, etc. In many instances, the thoroughness and efficiency of the mixing has important economic significance. The growing number of uses for motionless mixers has laid emphasis on improvements in their construction and reduction in their cost of manufacture.

Among the objectives of the design of motionless mixers is to provide a desired degree of mixing within the least axial dimension of a conduit and with the least pressure drop. The cost of a motionless mixer installation is directly proportional to its axial dimension. This is because the mixer modules are one of the main items of expense, and the fewer modules that can be used to accomplish a given degree of mixing, the less expensive will be the installation. In addition, the cost of pumping the fluid is significant, and, therefore, it is important to accomplish a given degree of mixing with the least possible pressure drop in the conduit.

A further cost factor relates to the fabrication of the modules themselves. In the modern industrial context, a mixing installation can require many hundreds, or even thousands, of modules. The cost of fabricating such modules can be very significant and, therefore, savings in this area are also sought.

Another factor which can become important is the ease of assembly both at the point of fabrication and in the field.

A final factor is maintenance in the field. The motionless mixer modules should be easy to clean and free from the accumulation of unmixed components of the materials intended for mixing.

In the mixing of substances with motionless mixers, the mixing action is influenced by the viscosity and flow rate of the substances. If the viscosity is low, and the flow rate high, the moment of inertia of the fluid as it changes direction in the conduit, can contribute significantly to the mixing action. Conversely, with highly viscous materials and slow flow rates, the kinetic energy of the materials plays little or no part in the mixing action.

The following criteria have been found important. First, the entire cross-section of the stream, at each stage along the conduit, should receive essentially the same mixing action. Otherwise, some parts will be mixed before others. In many instances mixing causes the viscosity to change, and non-uniformity of flow results. Thus, in any mixing arrangement in which the mixing action does not act substantially simultaneously on all parts of the cross-section of the stream, the mixing action must be continued longer in order to attain a given degree of mixing.

Since motionless mixers, more or less, by definition must be interposed in a moving stream, they usually are arranged to divide the stream into two or more flow paths. It follows that, if uniform mixing across the cross-section of the stream is to be provided, the separate flow paths must be identical both in mixing action and resistance to flow. In addition, motionless mixers should be designed to allow the material to flow as a mass without impeding one part of the stream more than another part. Likewise dead spaces should be avoided. Dead spaces which can allow a portion of the stream to stagnate obviously interfere with mixing. Likewise, the mixer must not have a free path extending along its axis through which fluids can flow in preference to being subjected to mixing.

In general, as the mixing action of a motionless mixer module is increased so as to shorten the axial distance along the conduit to be devoted to the mixing, the changes to the module to accomplish this objective also increase the pressure drop. At some point, the gains due to shortening the mixing column are offset by the requirement for increased pumping pressure, and, therefore, an objective in the design of a motionless mixer is to meet the optimum balance between these two factors.

A further aspect of mixing which needs to be taken into consideration is that with motionless mixers, experience has shown that the most efficient results are obtained if the stream is subjected to a strong mixing action substantially along a line uniformly across its cross-section in a strong mixing zone, and, thereafter, the stream is then allowed to follow an even flow for a finite period in preparation for entrance into a further strong mixing zone.

A well-known motionless mixer which met many of the above criteria is described in Armeniades U.S. Patent No. The Armeinades mixer comprises a series of modules formed out of short twisted helix elements connected orthogonally at their ends to both split the stream, and reverse its helical flow path between each element. In a typical form of the Armeniades structure, the helix of each module is formed to turn the stream 180° and the axial dimension of the modules is 1½ times the inside diameter of the conduit. Such a module is said to have a "pitch ratio" of 1:1.5, meaning that in an axial dimension of 1½ times the I.D. of the tube, the helix will twist 180°. With such modules, it was found that a favorable strong mixing zone was established along a transverse line immediately downstream of the entrance point of each module. Also, virtually the entire cross-section of the stream was subjected to this strong mixing action, and, subsequently, the entire stream entered a relaxation zone downstream in preparation for entering a further strong mixing zone. In addition, the Armeniades structure provided precisely equal flow paths on each side of the modules, no local obstructions, and virtually no dead places other than a dead space which might occur along a small line at the ends of the modules if they were not tapered. In addition, although a helix, as used in Armeniades, seems to provide a straight line along its axis along which fluids might flow, in actual fact, with a helix the flow path continuously crosses the axis diagonally, and at no point can the fluid follow a straight line along the axis.

The Armeniades structure, however, has a number of serious drawbacks as follows: first, a helix is difficult to form accurately. A crude helix can be formed by twisting a narrow strip of material, but since the edges of a helix must be substantially longer than the centerline, unless the edges of the material can stretch as the strip is being twisted, it will not form a helix. Even if the edges stretch, strain will be introduced and a true helix is apt not to be formed. These problems are aggravated geometrically as the size of the modules is increased. It is possible to mold modules of the Armeniades type of any size, but molds for this purpose are expensive and so are the parts made from them. Likewise, although theoretically dies can be made in helical form or other compound cured surfaces, so as to permit die stamping modules of the Armeniades type out of flat stock, such an operation would be very expensive.

Accordingly, efforts have been made in the past to cut motionless mixers out of flat stock and then bend them into various shapes without introducing expensive compound curves. Modules made in this way have been used in much the same way as are the Armeniades modules, that is, they are arranged in abutting, end to end relation in a tube. Usually, they are designed to split the stream into two paths and usually they are provided with vanes which cause the fluids to assume a tortuous path designed for mixing. A large number of patents have issued on various forms of such motionless mixers as cited in my prior co-pending application. The prior art static mixers which are most pertinent to the present invention are shown in the patents of Komax Systems, Inc., U.S. patents to King, U.S. Pat. Nos. 3,923,288 and 4,034,965, and the patent of Phillips Petroleum Company, U.S. patent to Crouch, U.S. Pat. No. 3,643,927.

The King mixers have the advantage of not requiring attachment between modules, but otherwise they have a number of drawbacks. First, in the King mixers, the angle between the mixing vanes and the wall of the tube is sharply acute in many areas where the general fluid flow path is across the line between the vane and the tube. This provides a dead space where the material will stagnate and, hence, be poorly mixed. Also in King, except for where the fluid passes his relatively short axially aligned baffles 18, the fluid is subjected to continuous turbulence without any clearly defined strong mixing zone extending on a line across the full cross section of the stream. Also in King there is virtually no relaxation zone in which the stream is forced to follow a helical flow path so as to condition it for entrance into a new strong mixing zone along a transverse line downstream. In addition, King's modules impose a relatively high pressure drop for the amount or mixing they accomplish. Finally, in King, the stream is not split equally and reversed along a transverse line between modules.

Crouch's modules, although composed solely of flat vanes, cause the fluid to take a generally helical path which is equally split at the end of each module. Crouch, however, has no distinct strong mixing action along a transverse line followed by a relaxation zone. In Crouch, as in King, there are acute-angle pockets away from the main flow path of the fluid, in which unmixed materials may stagnate. Further, Crouch's mixing is caused only by the flow of fluid over and along the line of reflex angles centrally of his modules. This provides some mixing but is less efficient than mixing in which the fluid flows transversely to the line of reflex angles, and far less efficient than mixing, in which the fluid flows over the free edge of a vane and meets a cross-flow of a second stream at an angle.

Accordingly, among the objects of this invention is the provision of a motionless mixer which can be manufactured by the mere cutting and bending of flat stock without any compound curves, having vanes for directing the fluid stream in a generally helical path alternately through a strong mixing zone in which virtually the entire cross section of the flowing material receives strong mixing, along a transverse line, followed by a relaxation zone in which the material is directed in a generally helical path in preparation for entrance into a further strong mixing zone where the fluid undergoes a reversal of helix direction along a line further downstream. An additional object is to provide a motionless mixer with such a strong mixing zone in which the materials being mixed are subjected to a sharp change of direction at the free end of a mixing vane. Another object is to provide a flow path for the fluid which generally follows the groove of any included angle so as to continuously flush out any stagnant pockets that might otherwise exist in the grooves formed by such included angles. Still another object is to provide for making such a static mixer by joining two or more sub-components with a minimum number of joints or weldments. A further object is to provide an arrangement of such static mixer modules in which a portion only of a module is provided respectively for fluid entrance and fluid exit, whereby the mixing effect of two modules is achieved with approximately the pressure drop of only one module. Further objects are to provide such motionless mixer modules conveniently in any size and for any size or shape of conduit, and with any desired pitch ratio.

BRIEF DESCRIPTION OF THE INVENTION

The motionless mixer combination of the present invention comprises a series of modules arranged in a conduit in abutting relation. Each module is formed of a flat plate the plane of which lies on the center axis of the conduit, with vanes connected at an angle to the plate to cause fluids flowing on each side of the plate through the conduit to take generally opposite helical paths from end to end of the module. The vanes are further arranged so that the direction of flow is substantially parallel to the line of all included angles between the vanes and the plate, and substantially transverse the line of all reflex angles between the vanes and the plates on both sides of the plates. The modules are made in two forms, with oppositely directed helixes, and are placed alternately and orthogonally in the conduit so as to split the stream equally and to reverse the helix flow paths to cause a fluid shearing action along the transverse line between modules.

The basic features of this arrangement are that since the flow paths are parallel to all included angles, stagnation is avoided; since the flow paths are transverse to the reflex angles, mixing is enhanced; and since there is fluid shearing action along the transverse line between modules, the efficiency of mixing is optimized.

More particularly, the motionless mixers of the present invention are made up of a plurality of basic mixer components each of which comprises a flat base plate in the form of an isosceles triangle with flat vanes connected at equal and opposite angles to the legs of the triangle. The vanes terminate along a transverse line defined by the intersection of the planes of the vanes and a plane normal to the base plate parallel to the base of the triangle passing the vertex of the triangle. The outer edges of the vanes follow the contour of the inner surface of the conduit (which is a segment of an elipse), with the base of the triangle normal to and intersecting the axis of the conduit. The vanes can be formed by bending them from a single plate or they may be secured to the base plate by welding or otherwise. The term "connected to" is intended to include both the integral and the separate but attached forms.

Basic mixer components of this construction are made in one of two forms. One form causes a helical flow path in one direction and the other form has the vanes bent oppositely to cause a helical flow path in the opposite direction. For simplicity of discussion the two forms are referred to respectively as "first" and "second" basic mixer components.

Motionless mixer modules are made up of combinations of these basic mixer components in several ways. One form of module has a mid-portion made up of two first or second basic mixer components connected along the bases of their respective isosceles triangles, and two end portions of similar basic components connected along the transverse end lines of their respective vanes. Modules of this construction are made up of either first or second basic mixer components to provide opposite helical flow paths and they are arranged in a mixing combination alternately and orthogonally.

In this form of the invention, the modules provide equally resistant flow paths for the fluid on each side of the module, and the direction of the flow on each side is also substantially parallel to the line of any included angles formed by the intersection of the plane of the vanes or the wall of the conduit. The flow paths are also substantially transverse to the line of any reflex angles formed by the vanes. This minimizes stagnation in the included angles and accentuates the mixing action of flow over the reflex angles.

An additional feature is that the fluid flow path on each side of the modules is substantially helical and oppositely diagonal to the axis of the conduit and, thus, when the fluids pass the free end line of an upstream module and enter a downstream module, the fluid undergoes both a splitting and a shearing action along a transverse line in a strong mixing zone as it enters the downstream module. This action enhances mixing.

A further feature is that once the fluid passes the strong mixing zone of a module, and continues downstream thereof, the flow is less disturbed and the fluid is allowed to relax in preparation for entering a further strong mixing zone in the next module further downstream. This type of alternate mixing and relaxing across the entire stream increases mixing efficiency.

In another embodiment the modules are made up of two pairs of basic components each with the components connected along the bases of their respective isosceles triangles and with the two pairs connected in series along the end lines of the vanes at one end. Such pairs can each be formed integrally by bending both sets of vanes, and, therefore, fabricating such a module requires only one weldment. Modules formed in this way provide a more severe mixing cross-current, or shear, along the transverse end line of the module, and, accordingly, a pitch ratio of 1:1.5 is preferred, whereas a pitch ratio of 1:1 is preferred for the embodiment first described.

Among the further features of the invention is that various combinations of the basic components can be used. Thus, an entire module can be made up of two basic components connected along the line of the bases of their respective isosceles triangles (such a module can be completely formed integrally by bending). A suitable form of such a module has a pitch ratio of 1:1¼.

An additional feature of the basic components is that single stamping dies can be used to form respectively all first and second basic components. Such components can be made with the vanes oversized, and, thereafter, conveniently placed in a rotating jig for milling or grinding so as to conform the surfaces of the edges of the vanes to the inside contour of the conduit as well as to conform the transverse end lines of the vanes to the transverse plane. This enhances combination of components when required. It also enhances mixing by reducing the dead space along the end line of the vanes. Also, by accurate conformance of the vane edges to the conduit walls, pockets and dead spaces are reduced, if not entirely eliminated.

Another feature of the flexibility provided by the basic component construction, is that a portion only of a module can be used at the entrance and exit points of a mixing arrangement. Thus, at the entrance, since the fluid will not be flowing in an opposite helical path, the mixing action due to fluid shear along the transverse line of the entrance will be relatively small. Therefore, the front portion of the lead module can be dispensed with, without serious loss. In addition, at the exit end of the entire mixer, there is no need for a relaxation zone and, therefore, the trailing portion of the final module can be eliminated without substantial loss. Thus, with the versatility of the present invention which the basic component construction provides, the useful portions only of the modules may be used at the entrance and exit ends and the mixing action of two modules can be provided but with approximately the pressure drop of only one module.

BRIEF DESCRIPTION OF THE DRAWINGS

Illustrative embodiments of the invention are shown in the drawings in which:

FIG. 2 is a plan view of a basic mixer component blank before the vanes have been bent;

FIG. 3 is a view in side elevations of the basic mixer component of FIG. 2 with vanes bent;

FIG. 4 is a view in end elevation of the basic mixer component of FIG. 2 with vanes bent;

FIG. 5 is a plan view of a blank for a pair of basic mixer components either formed as an integral piece or joined along the bases of their respective base plates;

FIG. 6 is a view in side elevation of the component pair of FIG. 5 with vanes bent;

FIG. 7 is a view in end elevation of the component pair of FIG. 5 with vanes bent;

FIG. 8 is a plan view of the blank of FIG. 5 after the vanes have been bent to the appropriate angle and slowing the fluid flow lines;

FIG. 9 is a view in cross section along the lines 9—9 of FIG. 8;

FIG. 10 is a side view of a complete module made up of four basic mixer components of FIG. 2 comprising two pairs as in FIGS. 5, 6 and 7 connected in series;

FIG. 11 is a side view of a complete module made up of a single central pair as shown in FIGS. 5, 6 and 7, with a basic mixer component at each end;

FIG. 12 is a view in end elevation at a reduced scale of the module of FIG. 11;

FIG. 13 is a plan view of the module of FIG. 12;

FIG. 14 is a side view of the module of FIG. 12;

FIG. 15 is a plan view of an alternative form of fabricating the modules of FIGS. 11 to 14;

DETAILED DESCRIPTION OF THE INVENTION

Figure 1:
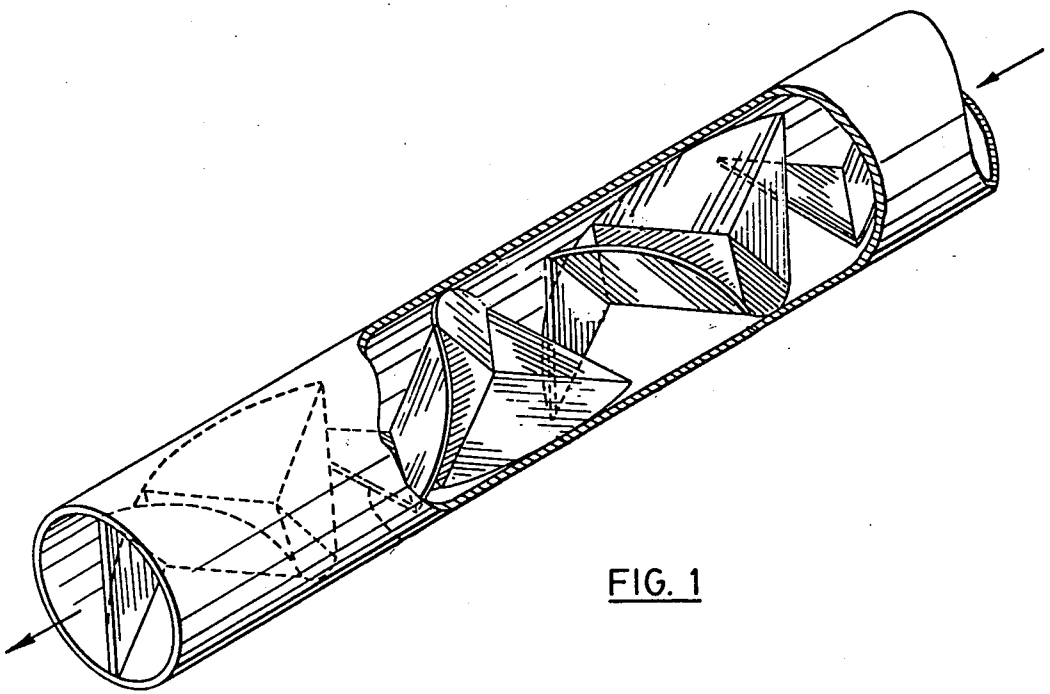
FIG. 1 is a perspective view of a conduit containing motionless mixer modules of the present invention with the wall of the conduit broken away to show the modules inside.
Figure 16:
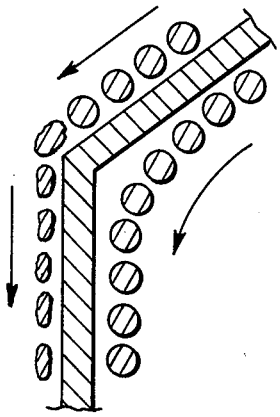
FIGS. 16 to 22 are diagrammatic illustrations of various forms and degrees of mixing action.
Figure 17:
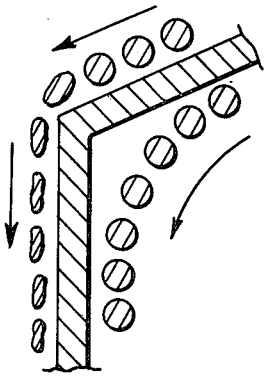
Figure 18:
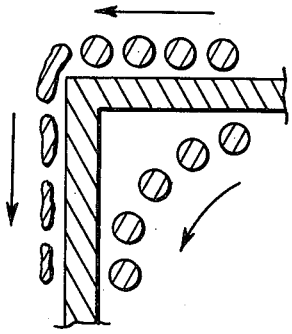
Figure 19:
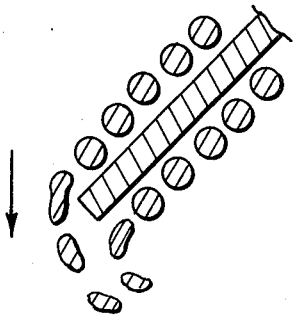
Figure 20:
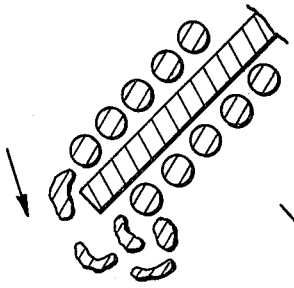
Figure 21:
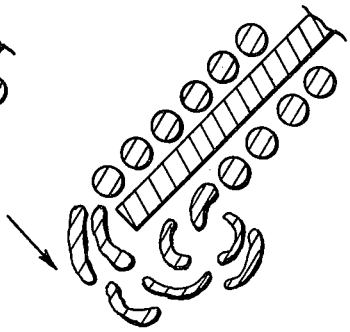

An understanding of the present invention requires a brief preliminary discussion of the mixing action of fluids flowing relative to mixing vanes. Any change of direction of a fluid causes at least slight mixing. The action of mixing is best illustrated by depicting balls or slugs of material being carried in a flowing stream as in FIGS. 16–21*. When the stream turns a corner as in FIG. 16, the balls on the outside flowing over the outer or reflex angle, will be stretched. This increases their surface area and promotes mixing. The balls on the inner side receive only slight deformation and a dead space appears at the vertex of the included angle. As the reflex angle is increased, as shown in FIGS. 17 and 18, the mixing on the outside increases while the dead space on the inside grows larger. When the stream flows past the free end of a vane and is subjected to a cross-current, the fluid on both sides of the vane receive more-or-less equal mixing action, which increases, of course, as the angle of the cross current, referred to hereafter as the "shear angle", increases. If the fluids can be turned so as to form a vortex at the same time as they flow past the free end of the vane, this too enhances the mixing action.

*This is not to say that all mixing is precisely in this manner but only that describing it in this manner is an aid to understanding it.

The present invention employs motionless mixer modules designed to enhance mixing both by the change direction over reflex angles and by the shearing action of cross currents and vortexes. The motionless mixer modules are made up of combinations of basic mixer components as shown in FIG. 2, each of which comprises a base plate 10 in the form of an isosceles triangle and vanes 12 connected along the legs of the triangle. The term "connected" as used herein and in the claims means joined in any manner as by being formed by bending from a single plate or by being attached as by welding. It being understood also that the line of the bend will normally have some radius and that the connection of the vanes to the base plates is not necessarily a sharp angle. The vanes 12 are bent up on one leg and down on the other leg by equal angles, referred to hereafter as the "bend angle", which should be at least 30°. The vanes terminate along a transverse line defined by the intersection of the plane of the vanes and a plane normal to the plane of the base plate, parallel to the line of the base of the base plate, passing through the apex of the triangle. The outer edges of the vanes are formed to conform to the inner wall of the conduit.

The basic mixer components are made in two forms referred to herein simply as "first" and "second" forms, with their vanes 12 bent oppositely so as to provide a helical flow path in one direction for first basic components and a helical flow path in the opposite direction for second basic components.

Motionless mixer modules are made by combining basic components. In one embodiment, a pair of like basic components are connected along the bases of their base plates 10 as in FIG. 5 to form a center section of the module. The ends of the module are then formed by a basic component connected at each end with the bases of each base plate 10 facing outwardly as in FIGS. 11 and 14. Such a complete module can also be made by forming the vanes of the end pieces as part of the same blank which forms the center portion of the module, as shown in FIG. 15. The construction of such a form is the same. The only difference is the location of the weldments. In such a construction, the weldments are located along the legs of the triangles of the base plates 10 of the two end pieces, instead of along the transverse end lines of the vanes of the basic components.

A mixing combination will comprise a series of these modules made up alternatively of first and second basic components, with the modules arranged along a conduit (which may be round, square or other shape) and substantially orthogonally positioned.

The flow paths of fluids employing such mixer modules are illustrated in FIGS. 8, 9 and 22 to 24. In FIGS. 8 and 9, a center section only is illustrated. The fluids enter at the left, flow upwardly and over the reflex angle formed between the vane 12 and the base plate 10, across the base plate at a substantial angle to the axis of the conduit, over the opposite reflex angle and down along the opposite vane 12. At each of these reflex angles, the fluid undergoes some mixing action. On the opposite side of the combined component, the fluids flow at an equal but opposite angle to the axis of the conduit. The opposite side is not illustrated because it is identical to that shown in FIGS. 8 and 9 if the structure were flipped over. It will be noted that the fluids follow the line of the included angles but flow substantially transversely over the reflex angles. In this way, the flow paths avoid dead spaces in the included angles and maximize the mixing action of the reflex angles.

Figure 22:
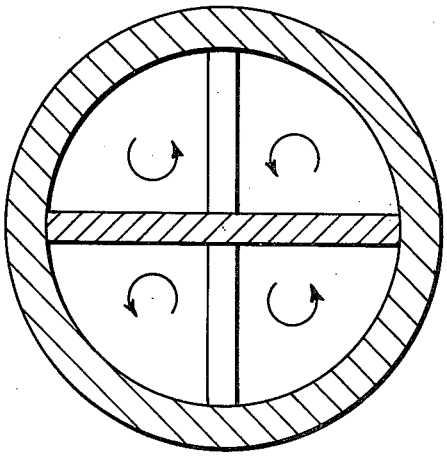
Figure 23:
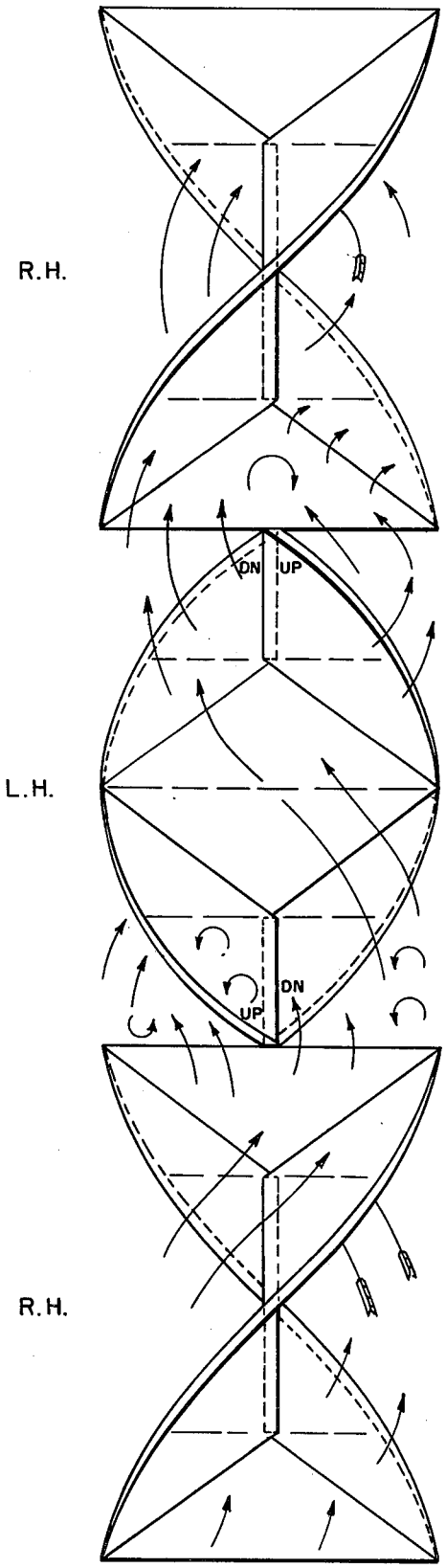
FIGS. 23 and 24 are diagrammatic views illustrating the mixing action of the modules of FIGS. 11 and 14.
Figure 24:
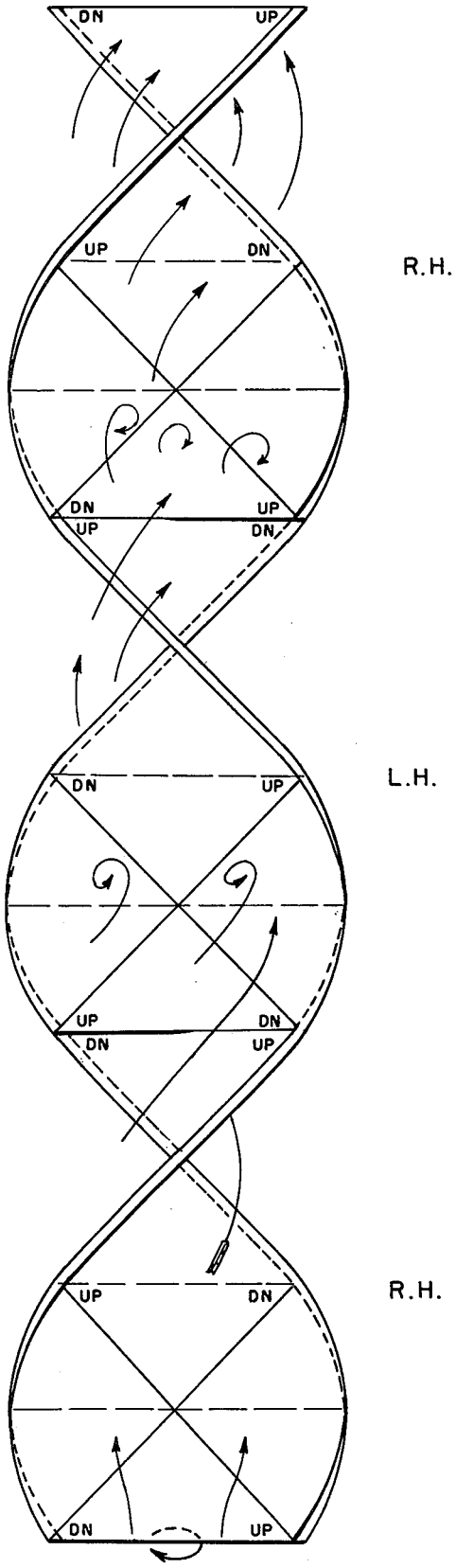

The mixing action at the end of the modules of FIGS. 11 and 14 is illustrated diagrammatically in FIGS. 22 to 24. Since the fluids have assumed substantially opposite helical paths, as they exit from the module they are subjected to a shearing and also a vortex forming action.

Figure 27:
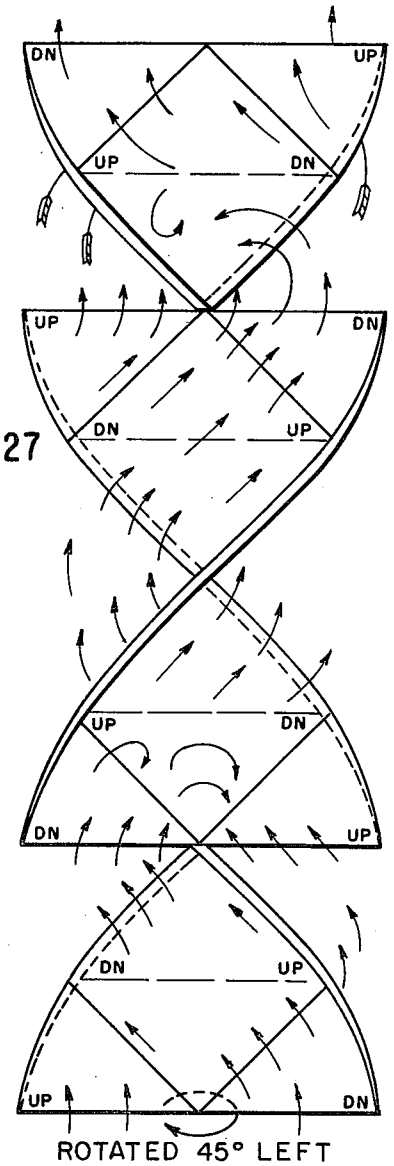
Figure 26:
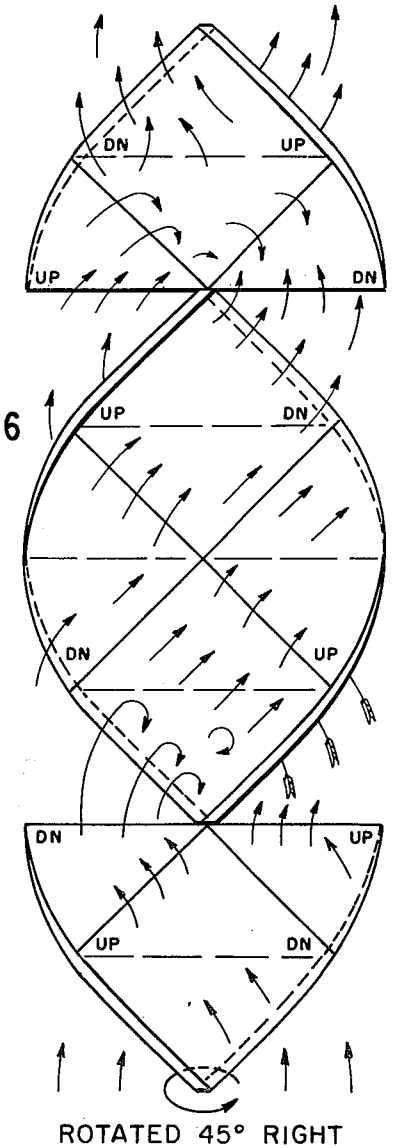
FIGS. 25 and 26 are diagrammatic views illustrating the mixing action of the modules of FIG. 10.
Figure 25:
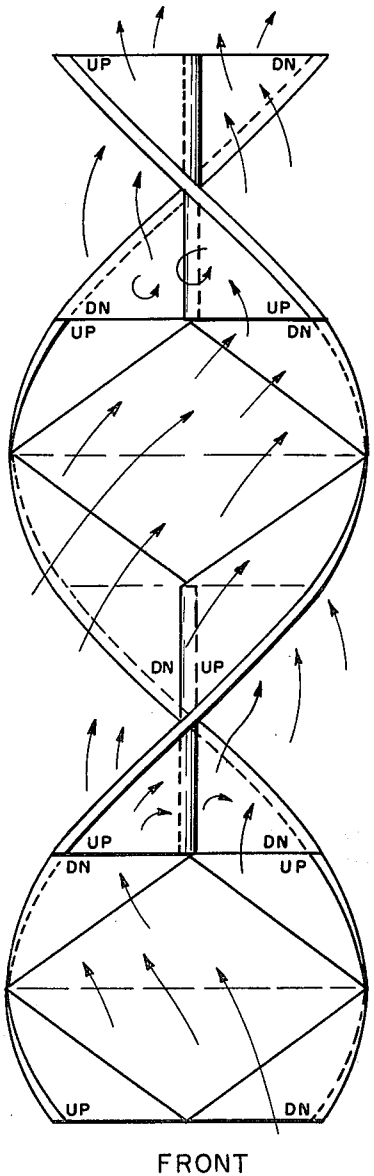

In a second embodiment, a pair of sub-modules of the configuration of FIG. 8 are connected in series along the transverse end lines of the vanes of one end of each. The flow paths are again as in FIGS. 8 and 9, but they provide greater shearing action along the transverse lines at the end of each module and as the fluids enter the next module, as illustrated in FIGS. 25 to 27. It will be seen that virtually the entire cross section of the fluid stream is subjected to the vortex action along a transverse line near the entrance point of the downstream module.

Motionless mixer modules can be made in various sizes, pitch ratios, and combinations of the basic mixer components within the spirit of the invention. For example, the pair of basic components of FIG. 8 formed by bending from a single flat plate can serve as a module by itself. In a preferred embodiment of such, a module will have its vanes bent at a bend angle of 90° and a pitch ratio of 1:1.25.

In addition, with modules of the form shown in FIG. 10, half-modules can be used at the beginning and end of the mixing series and obtain the mixing effect of two modules but with the surface resistance of only one.

The basic mixer components can be made by a simple stamping operation and their ends and edges can be conveniently milled or ground by the use of a rotating jig.

There is no special need to provide modules which turn the fluid precisely 180° for each module, it being entirely feasible to turn it more or less within each module depending upon the length of the relaxation zone required. Of course, if less (or more) than four basic components are used, the ends of the modules may not be parallel as in the modules herein shown. There is no reason, however, why they must be parallel, as long as the ends of the next module downstream are orthogonally placed so as to split the divided streams equally.

There are numerous further possibilities for variation coming within the spirit of the invention. A convenient way to describe the variations is to define only to the portion of the basic mixer component illustrated in the upper half of FIG. 2 because this portion is repeated throughout each module. For example, the basic component illustrated in FIG. 2 provides a twist of 45° for an axial length of $\frac{3}{4}$ r when r is the radius of the inside of the conduit. The vanes in FIG. 2 are bent up at an angle of 53° and a module made up of those components has a least angle to the wall is 59°. If four such basic components are put together, modules such as those shown in FIGS. 10 or 11 are provided imposing a helical twist of 180° on the fluid, and a pitch ratio of 1:1.5. The shear angle of the fluids in the strong mixing zone with such a module is 87°.

In the embodiment described above employing a single piece module the basic component provides a 90° twist for an axial length of 5/4 r. Two such basic components, therefore, provide a twist of 180° and a pitch ratio of 1:1.25. The vanes are bent up 90° and the least angle to the wall is 39°. Since the fluid flow is generally parallel to the line of the vertex of this angle, stagnation and accumulation do not occur. The shear angle of the fluids with such a module is 77.5°.

In another embodiment a basic component provides a 45° twist for R/2. This requires the vanes to be bent upwardly 65.9°. A module made up of four such basic components (or two of the integrally formed double components) has a least angle to the wall of 63° and a fluid shear angle of 109.5°. Such a shear angle is considered to be excessive for most usages. It provides strong mixing but also excessive pressure drop.

Another embodiment employs a basic component with a 30° twist for an R/2 axial length. By joining four such basic components (or two integral double components), the module will have a twist of only 120°, but a shear angle of 90° and a least angle to the wall of 69°. The modules of FIGS. 10, 11, and this latter module, are considered the modules having the greatest range of potential usage.

Since further modifications and variations of the embodiments herein illustrated and described will now be apparent to those skilled in the art, it is not intended that the invention be confined to the precise form of the embodiments shown but that it be limited instead only in terms of the appended claims.

I claim:

1. A motionless mixer combination for insertion into a conduit together with means for forcing a fluid containing materials to be mixed, through the conduit, comprising:

(a) a plurality of first basic mixer components comprising:

(1) a flat base plate in the form of an isosceles triangle;

(2) a pair of flat vanes connected respectively to the legs of the triangle at equal and opposite angles to the plane of the base plate; and, (3) the vanes terminating at a transverse end line defined by the intersection of the plane of the vanes and a plane normal to the plane of the base plate parallel to its base, passing through the apex of the triangle, and the outer edges of the vanes following the contour of the inner surface of said conduit;

(b) a plurality of second basic mixer components of identical construction to the first basic mixer components except that the vanes are connected at opposite angles to the base plates; and (c) means for positioning a first basic mixer component in the conduit in a downstream relation and substantially orthogonally to a second basic mixer component;

whereby said basic mixer components provide equally resistant, substantially helical flow paths for the fluid on each side of said components with the direction of flow being substantially parallel to the line of any included angle formed by the intersection of the plane of the vanes and the wall of the conduit, and substantially transverse to the line of any reflex angle formed thereby, and whereby the fluid passing the free end line of the upstream component undergoes a splitting and a fluid shearing action along a transverse line as it passes into the downstream component.

2. The motionless mixer combination of claim 1 further characterized by:

(d) the first and second basic mixer components of element (c) abutting at the midpoint of the bases of their respective isosceles triangles.

3. The motionless mixer combination of claim 2 further characterized by:

(e) an additional first basic mixer component connected to the first basic mixer component along the transverse end lines of their respective vanes; and, (f) an additional second basic mixer component connected to the second basic mixer component in like manner.

4. The motionless mixer combination of claim 3 further characterized by:

(g) further first and second basic mixer components connected in series alternately along the line of the bases of their respective isosceles triangles and along the end lines of their respective vanes.

5. The motionless mixer combination of claim 4 further characterized by:

(h) mixer modules made up of four like basic mixer components in series with the two middle such components connected along the bases of their respective isosceles triangles, and the two end components connected along the transverse end lines of their respective vanes; and, (i) a plurality of such modules arranged alternately in series in said conduit.

6. The motionless mixer combination of claim 5 further characterized by:

(j) the modules of element (h) having a pitch ratio of 1-1.

7. The motionless mixer combination of claim 6 further characterized by:

(k) the series of element (i) terminating at each end in a half-module only.

8. The motionless mixer combination of claim 1 further characterized by:

(l) the first and second basic mixer components of element (c) abutting at the midpoint of the transverse end lines of their respective vanes.

9. The motionless mixer combination of claim 8 further characterized by:

(m) an additional first and second basic mixer component each connected respectively to the first and second mixer components of element (c).

10. The motionless mixer combination of claim 9 further characterized by:

(n) further first and second basic mixer components connected to like components in series alternately along the base lines of their respective isosceles triangles, and along the transverse end lines of their respective vanes.

11. The motionless mixer combination of claim 10 further characterized by:

(o) mixer modules made up of at least four like basic mixer components in series with internal pairs thereof connected along the base lines of their respective isosceles triangles, and with each end terminating with the transverse end line of the vanes of a basic mixer component; and, (p) a series of said modules in said conduit alternating between modules made up of first basic mixer components, and modules made up of second basic mixer components.

12. The motionless mixer combination of claim 11 further characterized by:

(q) the pitch ratio of said modules being 1:1.5.

* * * * *